US009921508B2

(12) United States Patent
Lee et al.

(10) Patent No.: US 9,921,508 B2
(45) Date of Patent: Mar. 20, 2018

(54) METHOD OF PREPARING POLY-SILICIC-FERRIC COAGULANT (PSFC) FOR ELECTROSTATIC CHARGE IMAGE DEVELOPING TONER

(71) Applicant: S-PRINTING SOLUTION CO., LTD., Suwon-si (KR)

(72) Inventors: Sung-hwa Lee, Suwon-si (KR); Il-hyuk Kim, Hwaseong-si (KR); Yeong-sik Mun, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/085,416

(22) Filed: Mar. 30, 2016

(65) Prior Publication Data

US 2017/0031256 A1 Feb. 2, 2017

(30) Foreign Application Priority Data

Jul. 29, 2015 (KR) ..... 10-2015-0107416

(51) Int. Cl.
*G03G 9/08* (2006.01)
*G03G 9/097* (2006.01)
*G03G 9/093* (2006.01)

(52) U.S. Cl.
CPC ..... *G03G 9/09708* (2013.01); *G03G 9/0804* (2013.01); *G03G 9/09328* (2013.01); *G03G 9/09371* (2013.01); *G03G 9/09392* (2013.01)

(58) Field of Classification Search
CPC ..... G03G 9/0804
See application file for complete search history.

(56) References Cited

U.S. PATENT DOCUMENTS

| | | | | |
|---|---|---|---|---|
| 2,217,466 | A | 10/1940 | Baylis | |
| 2,310,009 | A | 2/1943 | Baker et al. | |
| 2,444,774 | A | 7/1948 | Hay | |
| 4,923,629 | A | 5/1990 | Hasegawa et al. | |
| 4,927,498 | A | 5/1990 | Rushmere | |
| 5,482,693 | A | 1/1996 | Rushmere | |
| 7,338,617 | B2 | 3/2008 | Koga et al. | |
| 2013/0157187 | A1* | 6/2013 | Zhou | C09C 1/56 430/107.1 |
| 2014/0199625 | A1* | 7/2014 | Qiu | G03G 9/0802 430/110.1 |
| 2015/0160574 | A1* | 6/2015 | Morales-Tirado | G03G 9/0804 430/108.8 |

FOREIGN PATENT DOCUMENTS

| | | | | |
|---|---|---|---|---|
| EP | 0340353 | * | 5/1988 | C02F 1/52 |
| JP | 2005-34746 | | 2/2005 | |
| JP | 2007-61811 | | 3/2007 | |
| JP | 2007-105731 | | 4/2007 | |
| JP | 2008-93568 | | 4/2008 | |
| JP | 2009-22925 | | 2/2009 | |
| KR | 10-0464714 | | 1/2005 | |
| KR | 10-2009-0024711 | | 3/2009 | |

OTHER PUBLICATIONS

R.C. Merrill, "Silicates in Soaps", The Journal of the American Oil Chemists' Society, (1948), 12 pages.
Lange and Spencer, "On the Mechanism of Activated Silica Sol Formation", Environmental Science and Technology, vol. 2, No. 3, Mar. 1968, pp. 212-216.
T. Hasegawa et al., "Characteristics of Metal-Polysilicate Coagulants", Wat. Sci. Tech, vol. 23, pp. 1713-1722, 1991.
T. Tran et al., "Polysilicato-Iron for Improved NOM Removal and Membrane Performance", Journal of membrane Science, 280, 2006, pp. 560-571.
Wang et al., "A Pilot study of polysilicato-iron coalulant", Wat. Sci. Tech., vol. 2, No. 2, 2002, pp. 107-113.
Hashimoto et al., "Inorganic polymer coagulants of metal-polysilicate complex", Water supply, vol. 9, 1991, pp. 565-570.
Wand and Tang, "Modified inorganic polymer flocculant—PFSi: its preparation, characterization and coagulation behavior", Water Research, vol. 35, No. 14, 2001, pp. 3418-3428.

* cited by examiner

*Primary Examiner* — Hoa V Le
(74) *Attorney, Agent, or Firm* — Staas & Halsey LLP

(57) ABSTRACT

Provided is a method of preparing a poly-silicic-ferric coagulant (PSFC) having a controlled aggregating strength. In particular, according to an embodiment, provided is a method of preparing a PSFC that may effectively suppress both formation of fine toner particles having a particle size that is smaller than a desired particle size and formation of coarse toner particles having a particle size that is greater than the desired particle size, wherein the PSFC for a toner is used in preparation of a toner by using an emulsion aggregation (EA) method. The PSFC for a toner prepared by using the method, according to an embodiment, significantly exhibits a controlled aggregating strength, and thus a viscosity of an emulsion aggregation solution for the toner preparation is appropriate, which results in suppressing production of fine toner particles and coarse toner particles. In this regard, a toner preparation yield may improve.

5 Claims, No Drawings

METHOD OF PREPARING POLY-SILICIC-FERRIC COAGULANT (PSFC) FOR ELECTROSTATIC CHARGE IMAGE DEVELOPING TONER

CROSS-REFERENCE TO RELATED APPLICATION

This application claims the benefit of Korean Patent Application No. 10-2015-0107416, filed on Jul. 29, 2015, in the Korean Intellectual Property Office, the disclosure of which is incorporated herein in its entirety by reference.

BACKGROUND

1. Field

The present disclosure relates to a coagulant particularly appropriate in preparation of a toner for electrostatic charge image development in an electro-photographic image forming apparatus.

2. Related Art

Toners may be prepared by using various methods. For example, a toner may be prepared by using an emulsion aggregation (EA) method. The emulsion aggregation method generally includes dispersing and aggregating a binder resin latex, a colorant, and a releasing agent in an aqueous medium. An emulsifying agent is used for stable dispersion of the binder resin latex, colorant, and releasing agent. Then, a coagulant is added to a dispersion including binder resin latex particles, colorant particles, and releasing agent particles. In this regard, the binder resin latex particles, colorant particles, and releasing agent particles aggregate and thus form toner particles containing the binder resin, colorant, and releasing agent.

One of the most important factors with respect to growth of toner particles by aggregation is using a coagulant that has an appropriate aggregating strength so that a toner having a particle size within a desired range is mainly produced. In other words, a coagulant for a toner is required to have an appropriate aggregating strength so that production of fine toner particles and coarse toner particles can be lowered, thus, improving a yield of the toner particles having a desired size. Herein, the term "fine toner particles" refers to toner particles having a particle size that is smaller than the desired particle size, and the term "coarse toner particles" refers to toner particles having a particle size that is bigger than the desired particle size.

A poly-silicic-ferric coagulant (PSFC) has been studied as a coagulant used in the preparation of a toner by using an emulsion aggregation (EA) method in an aqueous medium. PSFC refers to a polysilicic acid attached with iron ions. The PSFC has been primarily used as a coagulant for water treatment. The coagulant for water treatment aggregates an organic material and fine particles in waste water to facilitate precipitation and removal of solid particles and an organic material from the waste water. Since a larger size of the aggregate results in a higher efficiency of precipitation and removal in water treatment, in general, a coagulant for water treatment, such as the PSFC, is required to form aggregates as large in size as possible.

On the other hand, in the preparation of a toner by using an EA method, both formation of fine particles having a particle size smaller than a desired size and formation of coarse particles having a particle size greater than a desired size need to be suppressed. For example, when an aggregating strength of a coagulant for a toner is too weak, raw materials (that is, a binder resin latex, a colorant, and a releasing agent) do not aggregate effectively, and thus fine particles are formed, which results in a decrease in the yield of a toner having the desired particle size. When the aggregating strength of a coagulant for a toner is too strong, the raw materials excessively aggregate, and thus coarse particles are formed, which results in a decrease in the yield of a toner having the desired particle size. Also, when the aggregating strength of a coagulant for a toner is too weak or too strong, toner particles having an intended ratio of raw materials (that is, toner particles having substantially the same composition as a mixing ratio of raw materials) may not be formed. Therefore, the preparation of a toner by using an EA method needs a coagulant having a controlled aggregating strength.

However, in general, a conventional coagulant for water treatment, such as a PSFC, is not appropriate in suppressing formation of coarse particles, and thus, it is difficult to obtain the PSFC (e.g., the PSFC having the controlled aggregating strength) appropriate in the preparation of a toner by using an EA method.

SUMMARY

Provided is a method of preparing a poly-silicic-ferric coagulant (PSFC) having a controlled aggregate strength. In particular, provided is a method of preparing a PSFC for a toner which is used in toner preparation using an emulsion aggregation (EA) method, wherein the PSFC for a toner may effectively suppress both formation of fine particles having a particle size smaller than a desired size and formation of coarse particles having a particle size greater than a desired size.

Additional aspects will be set forth in part in the description which follows and, in part, will be apparent from the description, or may be learned by practice of the presented embodiments.

According to an aspect of an embodiment, a method of preparing a coagulant for a toner includes polymerizing silicic acid in a silicic acid aqueous solution having a silicon content and a pH to form a polymerized silicic acid; and mixing iron ions and the polymerized silicic acid to produce the coagulant, wherein the silicon content, the pH, and a polymerization time of the polymerizing satisfy Formula 1 below:

$$\log_e T-(11.7-3.0\times pH-2.6\times\log_e 2.139C)\leq 6.65 \quad \text{<Formula 1>}$$

wherein, T is a value in hours of the polymerization time, and C is a value in wt % of the silicon content.

DESCRIPTION OF EMBODIMENTS

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items.

According to an aspect of the present disclosure, an embodiment of a method of preparing a poly-silicic-ferric coagulant (PSFC) for a toner includes polymerizing silicic acid for a polymerization time in a silicic acid aqueous solution having a silicon content and a pH to form a polymerized silicic acid; and reacting iron ions and the polymerized silicic acid to produce a PSFC, wherein the silicon content, the pH, and the polymerization time satisfy Formula 1 below.

$$\log_e T-(11.7-3.0\times pH-2.6\times\log_e 2.139C)\leq 6.65 \quad \text{<Formula 1>}$$

where T is a value in hours of the polymerization time, and C is a value in wt % of the silicon content.

According to the present disclosure, the PSFC for a toner prepared under conditions in which the polymerization time (T) in the forming of the polymerized silicic acid satisfies Formula 1 and exhibits a significantly controlled aggregating strength; thus, an emulsion aggregation reaction solution for toner preparation may have an optimum viscosity. In this regard, production of fine toner particles and coarse toner particles may be minimized, which results in maximization of a toner preparation yield. In other words, when the PSFC for a toner prepared under a condition of a polymerization time being longer than a particular value is used, a viscosity of an emulsion aggregation reaction solution for toner preparation rapidly increases, and accordingly a toner preparation yield rapidly decreases. In particular, when the PSFC for a toner prepared under a condition where the value of "$\log_e$ T−(11.7−3.0×pH−2.6×$\log_e$2.139C)" is higher than about 6.65 is used, a viscosity of an emulsion aggregation reaction solution for toner preparation rapidly increases, and accordingly production of coarse particles rapidly decreases, which results in a rapid decrease of a toner preparation yield. In other words, when the PSFC for a toner prepared under a condition where the value of "$\log_e$ T−(11.7−3.0×pH−2.6×$\log_e$2.139C)" is less than or equal to about 6.65 is used, a toner preparation yield rapidly increases.

The physical significance of Formula 1 is that the polymerization time is less than or equal to a particular value under conditions of a given silicon content and a given pH. That is, when the polymerization time is too long under conditions of a given silicon content and a given pH, PSFC having "controlled" aggregating strength may not be obtained. Whereas, when the polymerization time is less than or equal to a particular value under conditions of a given silicon content and a given pH, a PSFC having significantly "controlled" aggregating strength may be obtained.

In some embodiments, the silicon content, the pH, and the polymerization time may satisfy Formula 2:

$$5.93\leq\log_e T-(11.7-3.0\times pH-2.6\times\log_e 2.139C)\leq 6.65 \quad \text{<Formula 2>}$$

According to the present disclosure, when the PSFC for a toner prepared under a condition of a polymerization time being less than a particular value is used, a viscosity of an emulsion aggregation reaction solution for toner preparation rapidly decreases, and accordingly a toner preparation yield rapidly decreases. In particular, when the PSFC for a toner prepared under a condition where the value of "$\log_e$T −(11.7 −3.0×pH −2.6×$\log_e$2.139C)" is less than about 5.93 is used, a viscosity of an emulsion aggregation reaction solution for toner preparation rapidly decreases, and accordingly production of fine particles rapidly increases, which results in a rapid decrease of a toner preparation yield. In other words, when the PSFC for a toner prepared under a condition where the value of "$\log_e$T −(11.7 −3.0×pH −2.6×$\log_e$2.139C)" is greater than or equal to about 5.93 is used, a toner preparation yield rapidly increases. But, when the value of "$\log_e$T −(11.7 −3.0×pH −2.6×$\log_e$2.139C)" is greater than or equal to about 5.93, a rapid decrease in the toner preparation yield may be seldom and only occurs in exceptional cases. The physical significance of Formula 2 is that the PSFC having "controlled" aggregation strength is very difficult to be obtained when the polymerization time is too short under conditions of a given silicon content and a given pH.

In some embodiments, the silicon content, the pH, and the polymerization time may satisfy Formula 3:

$$6.20\leq\log_e T-(11.7-3.0\times pH-2.6\times\log_e 2.139C)\leq 6.65 \quad \text{<Formula 3>}$$

According to the present disclosure, when the value of "$\log_e$ T−(11.7−3.0× pH−2.6×$\log_e$2.139C)" is greater than or equal to about 6.20, exceptional cases of rapid decrease in the toner preparation yield do not occur.

A silicon content of the silicic acid aqueous solution denotes a content of silicon atom in the silicic acid aqueous solution. In particular, the silicon content of the silicic acid aqueous solution is weight % of silicon atom contained in the silicic acid aqueous solution based on 100 weight % of the silicic acid aqueous solution at a point of time before adding a pH increasing agent in order to start polymerization of silicic acid (that is, for example, in order to increase the pH of the silicic acid aqueous solution from about 2.0 or lower to a pH range of about 3.0 to about 5.0).

The pH of the silicic acid aqueous solution denotes a pH of the silicic acid aqueous solution at a point of time when the polymerization of silicic acid starts (that is, for example, at a point of time right after adding all pH increasing agents needed to increase the pH of the silicic acid aqueous solution from about 2.0 or lower to a pH range of about 3.0 to about 5.0) and at the reaction temperature of the silicic acid polymerization.

The polymerization time is a time interval between the point of time when the silicic acid polymerization starts and the point of time when the silicic acid polymerization ends. When the pH of the silicic acid aqueous solution is about 2.0 or lower, the silicic acid polymerization does not occur effectively. When the pH of the silicic acid aqueous solution is in a range of about 3.0 to about 5.0, the silicic acid polymerization may occur effectively. Thus, the silicic acid polymerization may be started by increasing the pH of the silicic acid aqueous solution from about 2.0 or lower to a pH range of about 3.0 to about 5.0. On the contrary, the silicic acid polymerization may be ended by decreasing the pH of the silicic acid aqueous solution from a pH range of about 3.0 to about 5.0 to about 2.0 or lower. The pH of the silicic acid aqueous solution may be increased by adding a pH increasing agent to the silicic acid aqueous solution. The pH increasing agent may be, for example, a basic material that generates hydroxide ions, and examples of the basic material may be sodium hydroxide, potassium hydroxide, ammonia, or an aqueous solution thereof. the pH of the silicic acid aqueous solution may be decreased by adding a pH decreasing agent to the silicic acid aqueous solution. The pH decreasing agent may be an acidic material that generates hydrogen ions, and examples of the acidic material may be sulfuric acid, nitric acid, hydrochloric acid, or an aqueous solution thereof.

The silicic acid aqueous solution may be, for example, obtained by dissolving silicic acid, a silicic acid precursor, or a combination thereof in water. The silicic acid precursor may be, for example, a metal salt of silicic acid. The metal salt of silicic acid may be, for example, aluminum silicate, calcium silicate, magnesium silicate, sodium silicate, or a combination thereof. In particular, for example, the metal salt of silicic acid may be sodium metasilicate ($Na_2SiO_3$), sodium orthosilicate ($Na_4SiO_4$), sodium disilicate ($Na_2Si_2O_5$), or a combination thereof.

The silicic acid aqueous solution having pH of 2.0 or lower may be, for example, prepared by mixing an aqueous solution of the metal salt of silicic acid with an aqueous solution of a strong acid, such as sulfuric acid, nitric acid, or hydrochloric acid. For example, sodium silicate hydrolyses as dissolved in water and thus forms an alkaline aqueous solution. The sodium silicate aqueous solution thus prepared may be slowly added to a strong acid aqueous solution to obtain a silicic acid aqueous solution having a pH of 2.0 or lower.

When the pH of the silicic acid aqueous solution is increased from about 2.0 or lower to a pH range of about 3.0 to about 5.0, polymerization of silicic acid in the silicic acid aqueous solution starts. Silicic acid forms polymerized silicic acid by forming a siloxane bridge (—Si—O—Si—). A monomer of silicic acid forms a dimer by water condensation with another silicic acid monomer, and grows to be an oligomer, and finally grows to be a polymer. Unlike organic polymerization, through which monomers forms a polymer having a long chain, silicon forms a ring-shaped polymer by internal-condensation due to a tendency to maximize a ≡Si—O—Si≡ unit and minimize a ≡Si—OH unit, and as the reaction continues, the silicon monomer grows to be a 3-dimensional particle.

When the silicon content (e.g., a content calculated based on a weight of silicon atom) in the silicic acid aqueous solution immediately before starting the polymerization is too low, the condensation occurs too slow, which may result in excessive increase in the polymerization time. When the silicon content in the silicic acid aqueous solution immediately before starting the polymerization is too high, the condensation occurs fast, which may result in excessive decrease in the polymerization time.

When the polymerization time is excessively increased, the process time for preparing a PSFC increases, and thus production efficiency may decrease. When the polymerization time is excessively decreased, the polymerization may not stop accurately within a polymerization time interval at which the produced PSFC has controlled aggregation strength, and the produced PSFC may be easily turn into gel, which may deteriorate storage stability and quality stability of the produced PSFC.

For example, the silicon content of the silicic acid aqueous solution immediately before starting the polymerization may be in a range of about 0.2 wt % to about 7.0 wt % based on 100 wt % of the total weight of the silicic acid aqueous solution. In some embodiments, the silicon content of the silicic acid aqueous solution immediately before starting the polymerization may be in a range of about 0.9 wt % to about 4.7 wt % based on 100 wt % of the total weight of the silicic acid aqueous solution. In some embodiments, the silicon content of the silicic acid aqueous solution immediately before starting the polymerization may be in a range of about 1.2 wt % to about 3.5 wt % based on 100 wt % of the total weight of the silicic acid aqueous solution.

Right after starting the polymerization, when pH of the silicic acid aqueous solution is too low, condensation may occur slowly due to lack of an electrolyte content in the reaction solution. On the other hand, right after starting the polymerization, when the pH of the silicic acid aqueous solution is too high, an electrolyte content in the reaction solution is too high, and thus condensation may occur fast, which may result in gelation of the polymerized silicic acid in the short period of time. For example, right after starting the polymerization, the pH of the silicic acid aqueous solution may be in a range of about 3.0 to about 5.0 at the given polymerization temperature. In some embodiments, right after starting the polymerization, the pH of the silicic acid aqueous solution may be in a range of about 3.5 to about 4.5 at the given polymerization temperature. In some embodiments, right after starting the polymerization, the pH of the silicic acid aqueous solution may be in a range of about 3.8 to about 4.2 at the given polymerization temperature.

When the polymerization temperature (e.g., a temperature of the silicic acid aqueous solution) is too low, the condensation is slowed down, and thus productivity may decrease. When the polymerization temperature increases, the reaction rate increases, and thus process control (e.g., controlling the polymerization degree) may be difficult. For example, the polymerization temperature may be in a range of about 16° C. to about 40° C. In some embodiments, the polymerization temperature may be in a range of about 18° C. to about 38° C. In some embodiments, for more precise control of the polymerization degree, the polymerization temperature may be in a range of about 20° C. to about 36° C.

When the pH of the silicic acid aqueous solution is decreased back to 2.0 or lower, the polymerization of silicic acid ends. Next, when iron ions and the polymerized silicic acid are mixed, a PSFC may be produced. For example, when an iron ion source is added to the silicic acid aqueous solution in which the silicic acid polymerization is finished, a complex of the iron ions and the polymerized silicic acid may be formed. The iron ion source may be, for example, an acidic aqueous solution including iron ions, where the acidic aqueous solution is obtained by dissolving an iron compound, such as iron (II) chloride, in an acidic solution. A molar ratio of iron atoms to silicon atoms in PSFC may be controlled by controlling an amount of the iron ion source. The molar ratio of iron atoms to silicon atoms in PSFC may be, for example, about 1.1:1 to about 1:1. When an amount of the iron atoms is too low, aggregating strength may be low, and thus the aggregation efficiency of PSFC may deteriorate. When an amount of the iron atoms is too high, aggregating strength may be too high.

The PSFC provided according to an embodiment of the method disclosed herein may be effectively used as a coagulant for a toner in toner preparation using an EA method.

As used herein, toner particles having a particle size of greater than about 16 μm refer to "coarse particles", which are removed by, for example, screening and thus are not included in a toner product. Production of the coarse particles having a particle size of greater than about 16μm may be significantly decreased by using the PSFC according to an embodiment. In this regard, a yield of the toner preparation process using an EA method may rapidly increase by using the PSFC according to an embodiment. For example, the yield of the toner preparation process using an EA method using the PSFC according to an embodiment may be in a range of about 70 wt% to about 95 wt%. Here, the yield of the toner preparation process is defined as a wt% of the toner particles other than the coarse particles having a particle size greater than about 16 μm, based on 100 wt% of the total toner particles formed by using the EA method.

A toner prepared by using an EA method using the PSFC according to an embodiment may have D50 (v), for example, in a range of about 5.0 μm to about 8.0 μm. The toner prepared by using an EA method using the PSFC according to an embodiment may have an average circularity, for example, in a range of about 0.960 to about 0.990.

Thereinafter, one or more embodiments of a method of preparing a PSFC will be described in detail with reference to the following examples. However, these examples of the method of preparing a PSFC are not intended to limit the scope of the one or more embodiments.

Example

Examples 1 to 9 and Comparative Examples 1 to 7

Preparation of PSFC 279.5 g of distilled water and 10.5 g of sulfuric acid (at a concentration of 95 wt %) were added in a 1 L reactor to prepare a sulfuric acid aqueous solution having a concentration of 3.43 wt %. Separately, distilled water and sodium silicate ($Na_2SiO_3$) aqueous solution (Sigma Aldrich) (including an amount of silicon dioxide of 28.6 wt %) were put into a 500 ml beaker to prepare 290 g of each of sodium silicate aqueous solutions each having an amount of silicon dioxide of 6.4 wt %, 10 wt %, or 15 wt %.

A stirrer was equipped in the 1 L reactor containing the sulfuric acid aqueous solution, and the solution was vigorously stirred at a rate of 200 rpm. While vigorously stirring the solution, 290 g of each of the sodium silicate aqueous solutions each including an amount of silicon dioxide of 6.4 wt %, 10 wt %, or 15 wt % was added at a constant rate of 10 ml/min by using a master flex, and thus silicic acid aqueous solutions (pH=2.0 or lower) each having an effective silicon amount of 2.992 wt %, 4.674 wt %, or 7.012 wt % were prepared.

A 1 N sodium hydroxide aqueous solution was added to the silicic acid aqueous solution prepared as described above so that pH of the silicic acid aqueous solution was adjusted to an effective pH, and then the solution was stirred at room temperature (25° C.) for a polymerization time to polymerize silicic acid, and thus a polymerized silicic acid was prepared. Next, in order to stop the polymerization, a sulfuric acid aqueous solution at a high concentration of 3.2 M was added to decrease pH of the polymerized silicic acid aqueous solution to 1.5.

An iron (II) chloride aqueous solution (at a concentration of 44.2 wt %) was added to the polymerized silicic acid aqueous solution so that a molar ratio of silicon atoms and iron atoms is 1:1. Also, distilled water was added thereto, and the resultant mixture was stirred at a rate of 200 rpm for 5 minutes to prepare a PSFC aqueous solution (including the total solid content of 9.5 wt %).

The effective silicon content, the effective pH, and the polymerization time were varied to prepare PSFC aqueous solutions of Examples 1 to 9 and Comparative Examples 1 to 7. The conditions of the preparation process of the PSFC aqueous solutions of Examples 1 to 9 and Comparative Examples 1 to 7 are summarized in Table 1.

TABLE 1

| | Amount of Silicon dioxide (wt %); Amount of effective silicon (wt %) | Effective pH | Polymerization time (hour) | $\log_e T - (11.7 - 3.0 \times pH - 2.6 \times \log_e 2.139C)$ |
|---|---|---|---|---|
| Comparative Example 1 | 6.4; 2.992 | 4.0 | 6.0 | 6.92 |
| Comparative Example 2 | 6.4; 2.992 | 4.2 | 3.0 | 6.82 |

TABLE 1-continued

| | Amount of Silicon dioxide (wt %); Amount of effective silicon (wt %) | Effective pH | Polymerization time (hour) | $\log_e T - (11.7 - 3.0 \times pH - 2.6 \times \log_e 2.139C)$ |
|---|---|---|---|---|
| Comparative Example 3 | 6.4; 2.992 | 4.0 | 5.0 | 6.74 |
| Comparative Example 4 | 6.4; 2.992 | 4.4 | 1.5 | 6.73 |
| Example 1 | 15.0; 7.012 | 4.0 | 0.5 | 6.65 |
| Example 2 | 6.4; 2.992 | 4.0 | 4.0 | 6.51 |
| Example 3 | 6.4; 2.992 | 4.2 | 2.0 | 6.42 |
| Example 4 | 6.4; 2.992 | 4.4 | 1.0 | 6.33 |
| Example 5 | 6.4; 2.992 | 3.8 | 6.0 | 6.32 |
| Example 6 | 10.0; 4.674 | 4.0 | 1.0 | 6.29 |
| Example 7 | 6.4; 2.992 | 4.0 | 3.0 | 6.22 |
| Comparative Example 5 | 6.4; 2.992 | 3.8 | 5.0 | 6.14 |
| Example 8 | 6.4; 2.992 | 3.6 | 8.0 | 6.01 |
| Example 9 | 10.0; 4.674 | 4.0 | 0.7 | 5.93 |
| Comparative Example 6 | 6.4; 2.992 | 4.0 | 2.0 | 5.82 |
| Comparative Example 7 | 6.4; 2.992 | 3.6 | 6.0 | 5.72 |

<Evaluation of Storage Stability of PSFC>

15 g of each PSFC aqueous solution was added to a 20 ml vial, and remained in an oven at a temperature of 40° C. Then, the storage stability of the solution was evaluated by shaking the vial and observing the occurrence of gel formation on the wall of the vial, or the occurrence of air bubbles within the solution due to the viscosity of the solution, or the occurrence of precipitation or gelation. The storage stability was determined in terms of days before the occurrence of gel formation on the wall of the vial, or the occurrence of air bubbles within the solution due to the viscosity of the solution, or the occurrence of precipitation or gelation was observed.

<Viscosity Measurement of Emulsion Aggregation Reaction Solution for Preparing Toner and Toner Preparation Yield>

Preparation Example 1

Preparation of Latex Dispersion for Core and Latex Dispersion for Shell

A latex dispersion for core and a latex dispersion for shell were prepared as follows. In particular, a 30 L reactor equipped with a stirrer, a thermometer, and a condenser was installed in an oil bath. Distilled water and a surfactant (Dowfax 2A1) were added at amounts of 6,600 g and 32 g, respectively, then, a temperature of the reactor was increased to 70° C., and the mixture in the reactor was stirred at a rate of 100 rpm. Then, an emulsion mixture including 8,380 g of styrene, 3,220 g of butyl acrylate, 150 g of 2-carboxyethyl acrylate, and 226 g of 1,10-decandiol deacrylate, as monomers; 5,075 g of distilled water; 226 g of a surfactant (Dowfax 2A1); 530 g of polyethyleneglycol ethylether methacrylate, as a macromonomer; 188 g of 1-dodecanthiol, as a chain transfer agent; and 200 g of 2-carboxyethyl-2-propenoate, as an anionic charge control agent was stirred with a disc-type impellor at a rate in a range of 400 rpm to 500 rpm for 30 minutes, and the emulsion mixture was slowly added to the reactor for 1 hour. Then, after 10 minutes, a solution prepared by mixing 3,277 g of distilled water and 175 g of ammonium persulfate was added to the reactor, then, the mixture was allowed to react for about 8 hours, and then, the mixture was slowly cooled to room temperature, thereby completing the reaction. As a result, a latex dispersion (that is, a latex dispersion for core and a latex dispersion for shell).

After completing the reaction, a glass transition temperature (Tg) of binder resin in the latex dispersion was measured by using a differential scanning calorimeter (DSC), and the Tg was 62° C. Also, a number average molecular weight of the binder resin was measured through gel permeation chromatography by using a polystyrene standard sample, and the number average molecular weight was 50,000.

Preparation Example 2

Preparation of Colorant Dispersion 540 g of a cyan pigment (ECB303, available from Dainichiseika Color & Chemicals Mfg. Co., Ltd.), 27 g of a surfactant (Dowfax 2A1), and 2,450 g of distilled water were added to a 5 L reactor equipped with a stirrer, a thermometer, and a condenser, and the mixture in the reactor was slowly stirred for 10 hours to perform pre-dispersion. After performing the 10 hours of pre-dispersion, the contents in the mixture were further dispersed using a beads mill (Zeta RS, available from Netzsch Co., Germany) for 4 hours. As a result, a colorant dispersion was obtained.

After completing the dispersion, a particle diameter of the particles of the cyan pigment was measured by using a Multisizer 2000 (available from Malvern Instruments, Ltd.), and the particle diameter D50(v) was 170 nm. Here, D50(v) is defined as a certain particle diameter at which the cumulative volume of the particles, which is accumulated from particles with the smallest size to particles with the certain particle diameter, reaches 50% of the total volume of the particles.

Preparation Example 3

Preparation of was Dispersion 65 g of a surfactant (Dowfax 2A1) and 1,935 g of distilled water were added to a 5 L reactor equipped with a stirrer, a thermometer, and a condenser, and 1,000 g of wax (paraffin wax, HNP9, available from Nippon Seiro) was added to the reactor while slowly stirring the reactor at a temperature of 95° C. for about 2 hours. The wax was dispersed in the mixture for 30 minutes using a pressure discharge type homogenizer (available from Nippon Precision Machine). As a result, a wax dispersion was obtained.

After completing the dispersion, a particle diameter of the wax was measured using a Multisizer 2000 (available from Malvern Instruments, Ltd.), and the particle diameter D50 (v) was 200 nm.

Preparation Example 4

Preparation of Toner Parent Particles 13,881 g of the latex dispersion for a core, 2,238 g of the colorant dispersion, and 2,873 g of the wax dispersion were added to a 70 L reactor, and the mixture was mixed at a temperature of 25° C. for about 15 minutes at a stirring line speed of 1.21 m/s. 5,760 g of a solution mixture including a PSFC aqueous solution and a nitric acid aqueous solution (at a concentration of 1.88 wt %) at a weight ratio of the PSFC aqueous solution:nitric acid aqueous=1:2, as a coagulant, was added to the reactor, and then the mixture was homogenized using a homogenizer (T-50, available from IKA) while stirring the reactor at 25° C. at 50 rpm (at a stirring line speed of 1.79 m/sec) for 30 minutes, and the pH of the content in the reactor was 1.8. Then, the reactor was heated to 51° C., and then, while stirring at 2.42 m/s, the aggregation reaction proceeded until the D50(v) of the toner parent particles was in the range of 5.4 μm to 5.6 μm. Next, 5,398 g of the latex dispersion for shell was added thereto for about 20 minutes. Subsequently, the reactor was stirred until an average particle diameter of the toner parent particles was in the range of 6.0 μm to 6.2 μm. A 4 wt % sodium hydroxide aqueous solution was added to the reactor, and the reactor was stirred at 1.90 m/s until the pH reached 4 and at 1.55 m/s until the pH reached 7. While maintaining the stirring speed, the reactor was heated to 96° C. to unify each toner parent particle. When circularity measured using a FPIA-3000 (available from Sysmex, Japan) was in a range of 0.985 to 0.990, the reactor was cooled to 40° C., and the pH of the mixture was adjusted to 9.0. Then, the toner parent particles were isolated using a Nylon mesh having a pore size of 16 μm, and the isolated parent particles were washed four times using distilled water. Then, the toner parent particles were washed with a solution mixture prepared by mixing a 1.88 wt % nitric acid aqueous solution and distilled water so that the pH of the solution mixture was adjusted to 1.5. Then, the toner parent particles were washed four times with distilled water to remove a surfactant, or the like.

Measurement of Viscosity of Toner Emulsion Aggregation Reaction Solution after Adding PSFC Viscosities of the toner emulsion aggregation reaction solutions were measured using a Brookfield viscometer with spindle #63 at 200 rpm at 25° C. In the measurement, the latex dispersion for core, the colorant dispersion, and the wax dispersion were added into a reactor, and the mixture in the reactor was mixed by stirring at a temperature of 25° C. for about 15 minutes at a stirring line speed of 1.21 m/s. A solution mixture including a PSFC aqueous solution and a nitric acid aqueous solution (at a concentration of 1.88 wt %) at a weight ratio of the PSFC aqueous solution:nitric acid aqueous=1:2, as a coagulant, was added to the reactor, and then the mixture was homogenized using a homogenizer (T-50, available from IKA) at 25° C. at 50 rpm (at a stirring line speed of 1.79 m/sec) for 30 minutes to perform a homogenizing process. Then, a viscosity of the resultant mixture of the homogenizing process was measured by using a viscometer to evaluate aggregation performance of the PSFC.

Evaluation of Toner Preparation Yield

The toner remained on the Nylon mesh after toner isolation of the toner prepared in Preparation Example 4 using the Nylon mesh having a pore size of 16 μm was defined as coarse toner particles, and the isolated toner was defined as a normal toner. After drying, a toner actual yield was measured.

The results of evaluation performed on the PSFCs of Examples 1 to 9 and Comparative Examples 1 to 7 are shown in Table 2.

TABLE 2

| | $\log_e T - (11.7 - 3.0 \times pH - 2.6 \times \log_e 2.139C)$ | Stability (day) | PSFC yield (wt %) | Viscosity of toner emulsion aggregation reaction solution (cps) | Amount of coarse toner particles produced (wt %) | Toner preparation yield (wt %) |
|---|---|---|---|---|---|---|
| Comparative Example 1 | 6.92 | 8 | 98 | 262 | 17.0 | 81 |
| Comparative Example 2 | 6.82 | 6 | 98 | 251 | 16.0 | 82 |
| Comparative Example 3 | 6.74 | 10 | 98 | 251 | 16.0 | 82 |
| Comparative Example 4 | 6.73 | 7 | 98 | 252 | 17.0 | 81 |
| Example 1 | 6.65 | 5 | 97 | 215 | 7.0 | 90 |
| Example 2 | 6.51 | 21 | 97 | 220 | 4.0 | 93 |
| Example 3 | 6.42 | 21 | 97 | 221 | 4.0 | 93 |
| Example 4 | 6.33 | 21 | 97 | 222 | 4.0 | 93 |
| Example 5 | 6.32 | 21 | 97 | 222 | 4.0 | 93 |
| Example 6 | 6.29 | 21 | 96 | 220 | 4.0 | 92 |
| Example 7 | 6.22 | 21 | 96 | 210 | 4.0 | 92 |
| Comparative Example 5 | 6.14 | 30 | 85 | 92 | 3.0 | 82 |
| Example 8 | 6.01 | 21 | 97 | 219 | 4.0 | 93 |
| Example 9 | 5.93 | 25 | 95 | 200 | 7.0 | 88 |
| Comparative Example 6 | 5.82 | 30 | 85 | 90 | 3.0 | 82 |
| Comparative Example 7 | 5.72 | 30 | 85 | 91 | 3.0 | 82 |

As shown in Table 2, the PSFCs prepared in Examples 1 to 9 that satisfy the condition of Formula 1 ($\log_e T-(11.7-3.0\times pH-2.6\times\log_e 2.139C)\leq 6.65$) had rapidly improved toner preparation yield compared to those of the coagulants prepared in Comparative Examples 1 to 4 that do not satisfy the condition of Formula 1. Also, the PSFCs prepared in Examples 1 to 9 that satisfy the condition of Formula 2 ($5.93\leq\log_e T-(11.7-3.0\times pH-2.6\times\log_e 2.139C)\leq 6.65$) had rapidly improved toner preparation yield compared to those of the coagulants prepared in Comparative Examples 6 and 7 that do not satisfy the condition of Formula 2. When the condition of Formula 2 was satisfied, an exceptional case in which the toner preparation yield rapidly decreased occurred (e.g., Comparative Example 5). However, when the condition of Formula 3 ($6.20\leq\log_e T-(11.7-3.0\times pH-2.6\times\log_e 2.139C)\leq 6.65$) was satisfied (Examples 1 to 7), any exceptional case in which the toner preparation yield rapidly decreased did not occur.

According to one or more embodiments described above, a PSFC for a toner significantly exhibits controlled aggregating strength, and thus, allowing an emulsion aggregation reaction solution for toner preparation to have an appropriate viscosity, which results in minimizing production of fine toner particles and coarse toner particles, and thereby, improving a toner preparation yield.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims and their equivalents.

What is claimed is:

1. A method of producing a poly-silicic-ferric coagulant, the method comprising:

providing a silicic acid aqueous solution having a silicon content, and polymerizing silicic acid in the silicic acid aqueous solution for a polymerization time to form a polymerized silicic acid; and mixing iron ions and the polymerized silicic acid to produce the coagulant, wherein the silicon content, a pH of the silicic acid aqueous solution at a start of the polymerizing, and the polymerization time satisfy:

$$6.20\leq\log_e T-(11.7-3.0\times pH-2.6\times\log_e 2.139C)\leq 6.65$$

where T is the polymerization time in hours, and C is the silicon content in wt % based on 100 wt % of a total weight of the silicic acid aqueous solution, the pH of the silicic acid aqueous solution at the start of the polymerizing is in a range of about 3.5 to about 5.0, the silicon content is in a range of about 2.9 wt % to about 7.0 wt % based on 100 wt % of the total weight of the silicic acid aqueous solution, and in the mixing, the iron ions are added to silicic acid aqueous solution in an amount such that a molar ratio of iron atoms to silicon atoms in the produced coagulant is in a range of about 1.1:1 to about 1:1.

2. The method of claim 1, wherein the silicon content is below 3.5 wt % based on 100 wt % of the total weight of the silicic acid aqueous solution.

3. The method of claim 1, wherein a pH of the silicic acid aqueous solution during the polymerizing is in a range of about 3.5 to about 5.0.

4. A method of producing a toner using a poly-silicic-ferric coagulant, comprising:

producing the coagulant by a method including providing a silicic acid aqueous solution having a silicon content, and polymerizing silicic acid in the silicic acid aqueous solution for a polymerization time to form a polymerized silicic acid; and mixing iron ions and the polymerized silicic acid to produce the coagulant, wherein the silicon content, a pH of the silicic acid aqueous solution at a start of the polymerizing, and the polymerization time satisfy:

$$6.20 \leq \log_e T - (11.7 - 3.0 \times pH - 2.6 \times \log_e 2.139C) \leq 6.65$$

where T is the polymerization time in hours, and C is the silicon content in wt % based on 100 wt % of a total weight of the silicic acid aqueous solution, the pH of the silicic acid aqueous solution at the start of the polymerizing is in a range of about 3.5 to about 5.0, the silicon content is in a range of about 2.9 wt % to about 7.0 wt % based on 100 wt % of the total weight of the silicic acid aqueous solution, and in the mixing, the iron ions are added to silicic acid aqueous solution in an amount such that a molar ratio of iron atoms to silicon atoms in the produced coagulant is in a range of about 1.1:1 to about 1:1; and producing the toner by emulsion aggregation performed using the coagulant, the toner comprising 7 wt % or less of particles having a particle size greater than 16 μm.

5. The method according to claim 4, wherein the producing the toner by emulsion aggregation comprises:

preparing a emulsion aggregation reaction solution including the coagulant and having a viscosity of equal to or less than about 222 cps.

* * * * *